US006904848B2

(12) United States Patent
Norton et al.

(10) Patent No.: US 6,904,848 B2
(45) **Date of Patent: *Jun. 14, 2005**

(54) ROOF ASSEMBLY AND AIRFLOW MANAGEMENT SYSTEM FOR A TEMPERATURE CONTROLLED RAILWAY CAR

(75) Inventors: Allen E. Norton, Arlington, TX (US); Stephen W. Smith, Dallas, TX (US); William A. Knapp, Dallas, TX (US); Alex K. Hoover, Ft. Worth, TX (US); Ronald J. Zupancich, Cortland, TX (US); James J. Sommer, Apple Valley, CA (US)

(73) Assignee: TRN Business Trust, Dallas, TX (US)

( * ) Notice: Subject to any disclaimer, the term of this patent is extended or adjusted under 35 U.S.C. 154(b) by 3 days.

This patent is subject to a terminal disclaimer.

(21) Appl. No.: 10/802,019

(22) Filed: Mar. 16, 2004

(65) Prior Publication Data

US 2004/0173119 A1 Sep. 9, 2004

Related U.S. Application Data

(62) Division of application No. 10/071,173, filed on Feb. 8, 2002, now Pat. No. 6,722,287.

(60) Provisional application No. 60/267,882, filed on Feb. 9, 2001.

(51) Int. Cl.[7] ..... B61D 17/00

(52) U.S. Cl. ..... 105/404

(58) Field of Search ..... 105/396, 397, 105/401, 404, 409, 355

(56) References Cited

U.S. PATENT DOCUMENTS

| | | | | |
|---|---|---|---|---|
| 3,003,810 | A | 10/1961 | Kloote et al. | 296/31 |
| 3,142,265 | A | 7/1964 | Ford | 105/423 |
| 3,187,853 | A | 6/1965 | Glaser et al. | 189/34 |
| 3,206,946 | A | 9/1965 | Lindersmith et al. | 62/407 |
| RE26,131 | E | 12/1966 | Johansson | 105/409 |
| 3,301,147 | A | 1/1967 | Clayton et al. | |
| 3,323,471 | A | 6/1967 | Dean et al. | 105/401 |
| 3,481,642 | A | 12/1969 | Bonallack et al. | 296/31 |

(Continued)

OTHER PUBLICATIONS

Trinity Vision News Letter—Railcar News from Trinity Industries, Fall 2000 pp 1–8.

*Primary Examiner*—S. Joseph Morano
*Assistant Examiner*—Robert J. McCarry, Jr.
(74) *Attorney, Agent, or Firm*—Baker Botts L.L.P.

(57) ABSTRACT

A roof assembly mounted on a composite box structure with an air plenum assembly attached to and extending from an interior surface of the roof assembly. The composite box structure includes a pair of end wall assemblies, a pair of side wall assemblies, a floor assembly and the roof assembly. An opening may be formed in one end of the end wall assemblies to allow installing a temperature control system. An airflow management system may be incorporated into the composite box structure. The composite box structure may be assembled on a railway car underframe to form a temperature controlled railway car or an insulated box car.

19 Claims, 7 Drawing Sheets

U.S. PATENT DOCUMENTS

| | | | | |
|---|---|---|---|---|
| 3,711,148 | A | 1/1973 | Hindin | 296/28 |
| 3,777,430 | A | 12/1973 | Tischuk | 52/309 |
| 4,122,641 | A | 10/1978 | Bard et al. | 52/403 |
| 4,404,057 | A | 9/1983 | Morrison et al. | 156/324 |
| 5,088,434 | A | 2/1992 | Harding | 114/85 |
| 5,109,777 | A | 5/1992 | Ohmura et al. | 105/401 |
| 5,113,769 | A | 5/1992 | Okuno et al. | 105/422 |
| 5,274,979 | A | 1/1994 | Tsai | 52/595 |
| 5,277,011 | A | 1/1994 | Serrano Martin | 52/588 |
| 5,333,554 | A | 8/1994 | Yamada et al. | 105/397 |
| 5,403,063 | A | 4/1995 | Sjostedt et al. | 296/187 |
| 5,460,290 | A | 10/1995 | Hanning et al. | 220/694.1 |
| 5,677,029 | A | 10/1997 | Prevorsek et al. | 428/113 |
| 5,685,229 | A | 11/1997 | Ohara et al. | 105/397 |
| 5,716,487 | A | 2/1998 | Sumerak | 156/359 |
| 5,730,485 | A | 3/1998 | Sjostedt et al. | 296/182 |
| 5,765,485 | A | 6/1998 | Thoman et al. | 105/404 |
| 5,802,984 | A | 9/1998 | Thoman et al. | 105/404 |
| 5,988,074 | A | 11/1999 | Thoman | 105/404 |
| 6,000,342 | A | 12/1999 | Thoman et al. | 105/413 |
| 6,138,580 | A | 10/2000 | Thoman | 105/396 |
| 6,227,125 | B1 | 5/2001 | Schroeder et al. | 105/401 |
| 6,233,892 | B1 | 5/2001 | Tylman | 52/309.12 |
| 6,251,185 | B1 | 6/2001 | Morrison et al. | 118/681 |
| 6,290,279 | B1 | 9/2001 | Haight et al. | 296/97.23 |
| 6,722,287 | B2 * | 4/2004 | Norton et al. | 105/404 |

* cited by examiner 43
40
45
38
45
44
142
130
140
48
48
47
130
74
46
39
46
39
74
128
129
58
58
32
126
60
60
30
126
127
127
54
61
61
58
120
122
58
56
60
60
126
126
53
127
127
53
75
100
82
84a
88
75
55
55
246
246
54
221
248
248
221
84b
220
222
230
230
223
223
200

ROOF ASSEMBLY AND AIRFLOW MANAGEMENT SYSTEM FOR A TEMPERATURE CONTROLLED RAILWAY CAR

RELATED APPLICATION

This application is a Divisional of U.S. patent application Ser. No. 10/071,173 filed Feb. 8, 2002, now U.S. Pat. No. 6,722,287 and claims the benefit of Provisional Application No. 60/267,882 filed Feb. 9, 2001; and which is related to U.S. patent application Ser. No. 10/071,165, filed Feb. 8, 2002, Abandoned; U.S. patent application Ser. No. 10/071,168 filed Feb. 8, 2002, now U.S. Pat. No. 6,575,102; and U.S. patent application Ser. No. 10/071,513 filed Feb. 8, 2002, now U.S. Pat. No. 6,892,433 which claim priority from the same provisional application.

TECHNICAL FIELD

The present invention is related to a railway car having a composite box structure mounted on a railway car underframe and more particularly to a roof assembly and airflow management system for a temperature controlled railway car.

BACKGROUND OF THE INVENTION

Over the years, general purpose railway box cars have progressed from relatively simple wooden structures mounted on flat cars to more elaborate arrangements including insulated walls and custom designed refrigeration equipment. Various types of insulated box cars are presently manufactured and used. A typical insulated box car includes an enclosed structure mounted on a railway car underframe. The enclosed structure generally includes a floor assembly, a pair of side walls, a pair of end walls and a roof. The side walls, end walls and roof often have an outer shell, one or more layers of insulation and interior paneling.

The outer shell of many railway box cars often has an exterior surface formed from various types of metal such as steel or aluminum. The interior paneling is often formed from wood and/or metal as desired for the specific application. For some applications the interior paneling has been formed from fiber reinforced plastic (FRP). Various types of sliding doors including plug type doors are generally provided on each side of conventional box cars for loading and unloading freight. Conventional box cars may be assembled from various pieces of wood, steel and/or sheets of composite materials such as fiberglass reinforced plastic. Significant amounts of raw material, labor and time are often required to complete the manufacture and assembly of conventional box cars.

The underframe for many box cars include a center sill with a pair of end sills and a pair of side sills arranged in a generally rectangular configuration corresponding approximately with dimensions for the floor of the box car. Cross bearers are provided to establish desired rigidity and strength for transmission of vertical loads to the associated side sills which in turn transmit the vertical loads to the associated body bolsters and for distributing horizontal end loads on the center sill to other portions of the underframe. Cross bearers and cross ties cooperate with each other to support a plurality of longitudinal stringers. The longitudinal stringers are often provided on each side of the center sill to support the floor of a box car. Examples of such railway car underframes are shown in U.S. Pat. Nos. 2,783,718 and 3,266,441.

Traditionally, refrigerated box cars often have less inside height than desired for many types of lading and a relatively short interior length. Heat transfer rates for conventional insulated box cars and refrigerated box cars are often much greater than desired. Therefore, refrigeration systems associated with such box cars must be relatively large to maintain desired temperatures while shipping perishable lading.

Ballistic resistant fabrics such as Bulitex scuff and wall liners are currently used to form liners for highway truck trailers.

A wide variety of composite materials have been used to form railway cars and particular box cars. U.S. Pat. No. 6,092,472 entitled "Composite Box Structure For A Railway Car" and U.S. Pat. No. 6,138,580 entitled "Temperature Controlled Composite Box car" show some examples. One example of a composite roof for a railway car is shown in U.S. Pat. No. 5,988,074 entitled "Composite Roof for a Railway Car".

SUMMARY OF THE INVENTION

In accordance with teachings of the present invention, disadvantages and problems associated with insulated box cars, refrigerated box cars and other types of temperature controlled railway cars have been substantially reduced or eliminated. One embodiment of the present invention includes a roof assembly and an airflow management system satisfactory for use with a refrigerated box car or a temperature controlled railway car.

A roof assembly and airflow management system formed in accordance with teachings of the present invention provides a railway car with enhanced insulation, increased load carrying capacity, better temperature regulation, increased service life, and reduced maintenance costs as compared to a typical refrigerated box car. The roof assembly may be formed from vacuum molded, single pour, one piece, FRP panels or sheets. Various types of insulating materials and insulating foams may be encapsulated between two FRP panels or sheets. Vacuum infusion techniques may also be used to form portions of the roof assembly. Alternatively, a roof assembly may be formed from one or more pultrusions. Void spaces associated with such pultrusions are preferably filled with insulating foam.

Technical benefits of the present invention include flexible joints or flexible connections provided between a roof assembly and associated side wall assemblies and the end assemblies to allow expansion and contraction of these components in response to temperature changes while maintaining desired structural integrity of an associated composite box structure.

One aspect of the present invention includes an airflow management system defined in part by an air plenum attached to and extending from an interior surface of a roof assembly. The air plenum may direct air from a temperature control unit to selected portions of a composite box structure. The temperature control unit may be mounted on one of the end wall assemblies of the composite box structure. An interior bulkhead may be formed within the composite box structure adjacent to and spaced from the one end wall assembly to provide portions of an airflow path to return air to the temperature control unit.

BRIEF DESCRIPTION OF THE DRAWINGS

For a more complete understanding of the present invention, and the advantages thereof, reference is now made to the following written description taken in conjunction with the accompanying drawings, in which.

DETAILED DESCRIPTION OF THE INVENTION

Preferred embodiments of the invention and its advantages are best understood by reference to FIGS. 1A–12 of the drawings, like numerals are used for like and corresponding parts of the various drawings.

Various aspects of the present invention will be described with respect to a roof assembly which may be formed at least in part by vacuum infusion techniques. Portions of the roof assembly may be formed from vacuum molded, single pour, one piece FRP panels or sheets. However, teachings of the present invention may be satisfactorily used to form a roof assembly and/or an airflow management system using various techniques including injection molding, extrusion and/or pultrusion technologies. Teachings of the present invention are not limited to techniques and materials described in this application to form a roof assembly and an airflow management system.

U.S. Pat. No. 4,404,057 entitled "Reinforced Plastic Sheet Machine and Methods" and U.S. Pat. No. 6,251,185 entitled "System for Delivering Chopped Fiberglass Strands to a Preformed Screen" describe various examples of equipment and procedures which may be used to form all or portions of a roof assembly and/or an airflow management system incorporating teachings of the present invention. Roof assembly 40, which will be described later in more detail, may be purchased from Molded Fiberglass Companies located in Ashtabula, Ohio.

Figure 1A:
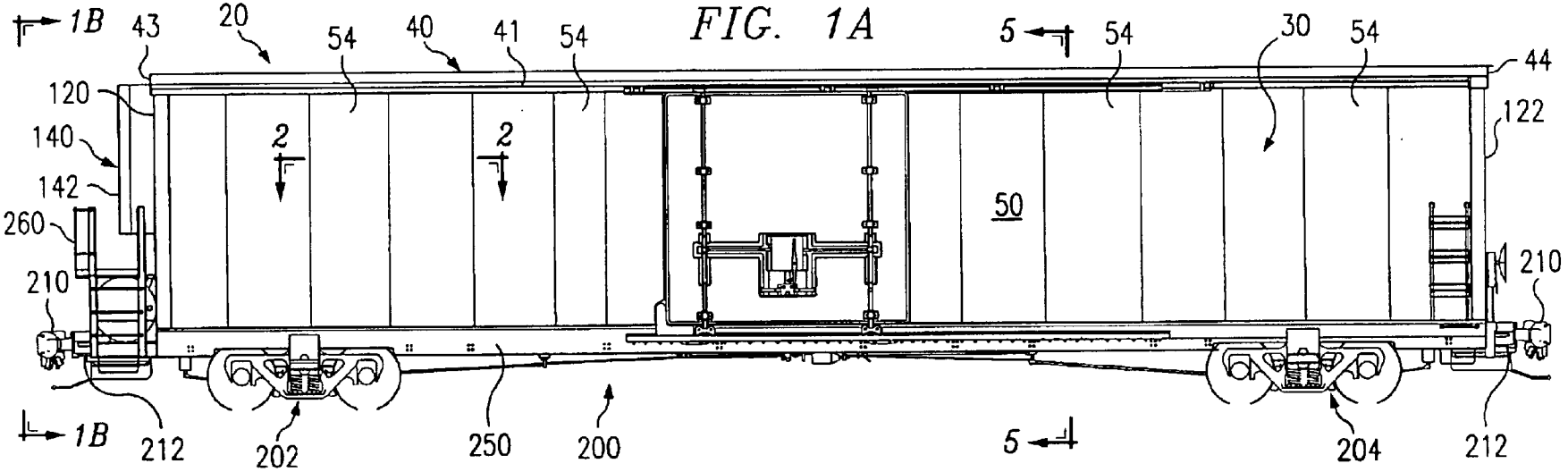
FIG. 1A is a schematic drawing in elevation showing a side view of a temperature controlled railway car having a roof assembly and an airflow management system incorporating teachings of the present invention.
Figure 1B:
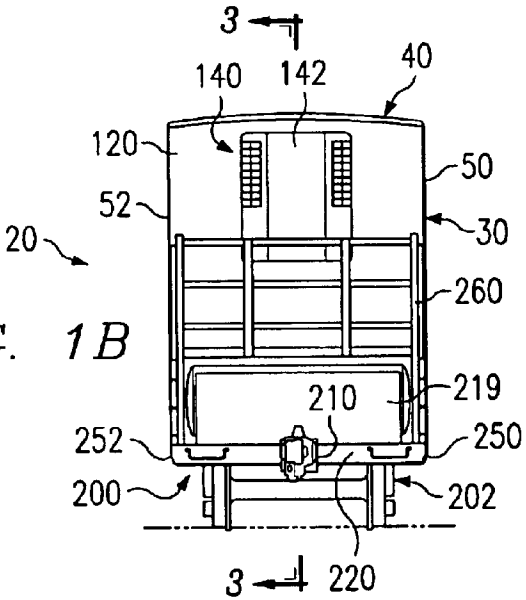
FIG. 1B is an end view of the temperature controlled railway car of FIG. 1A.
Figure 2:
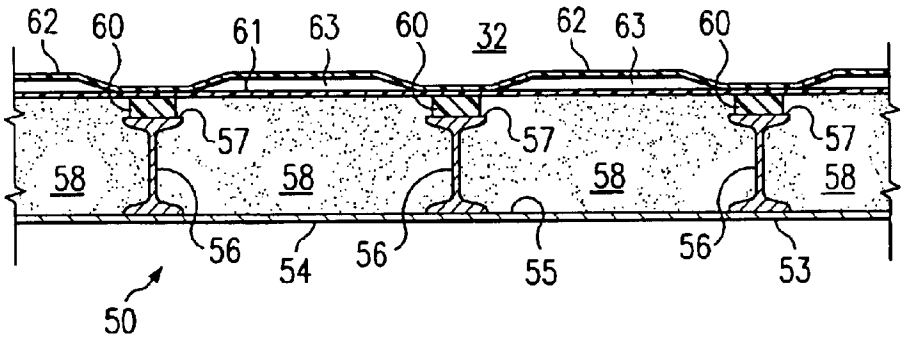
FIG. 2 is a schematic drawing in section with portions broken away of a side wall assembly taken along line 2—2 of FIG. 1A.

Temperature controlled railway car 20 incorporating teachings of the present invention is shown in FIGS. 1A and 1B with composite box structure 30 mounted on railway car underframe 200. Portions of composite box structure 30 and railway car underframe 200 are also shown in FIGS. 2–6. Temperature controlled railway car 20 preferably includes a roof assembly and an airflow management system formed in accordance with teachings of the present invention.

For some application, temperature controlled railway car 20 may have exterior dimensions which satisfy requirements of Plate F and associated structural design requirements of the Association of American Railroads (AAR). Forming various components of composite box structure 30 in accordance with teachings of the present inventions and assembling these components on railway car underframe 200 results in reducing the weight of temperature controlled railway car 20 while at the same time increasing both internal volume and load carrying capacity as compared to a conventional refrigerated box car satisfying Plate F requirements. A composite box structure and associated insulated box car or temperature controlled railway car may be formed in accordance with teachings of the present invention to accommodate various geometric configurations and load carrying requirements to meet specific customer needs concerning size and temperature specifications of different types of lading carried in the resulting box car.

The term "composite box structure" refers to a generally elongated structure having a roof assembly, a floor assembly, a pair of side wall assemblies, and a pair of end wall assemblies which cooperate with each other to provide a generally hollow interior satisfactory for carrying different types of lading associated with insulated box cars and refrigerated box cars. Portions of the roof assembly, floor assembly, side wall assemblies, end wall assemblies and/or airflow management system may be formed from conventional materials such as steel alloys and other metal alloys used to manufacture railway cars. Portions of the roof assembly, floor assembly, side wall assemblies, end wall assemblies and/or airflow management system may also be formed from composite materials such as advanced thermal plastics, insulating foam, fiberglass pultrusions and ballistic resistant fabrics. Various types of composite materials may be used to form a roof assembly and all or portions of an airflow management system in accordance with teachings of the present invention. Examples of some of the materials used to form a roof assembly and/or airflow management system incorporating with teachings of the present invention will be discussed throughout this application.

The term "FRP" may be used to refer to both fiber reinforced plastic and glass fiber reinforced plastic. A wide variety of fibers in addition to glass fibers may be satisfactory used to form portions of a roof assembly and an airflow management system incorporating teachings of the present invention.

Composite box structure 30 may be formed from several major components including roof assembly 40, side wall assemblies 50 and 52, floor assembly 80 and end wall assemblies 120 and 122. Major components associated with composite box structure 30 may be fabricated individually and then attached to or assembled on railway car underframe 200 to form temperature controlled railway car 20. Individually manufacturing or fabricating major components of composite box structure 30 allows optimum use of conventional railcar manufacturing techniques. For example, side stakes and door posts may be welded with top cords and side sills using conventional railcar manufacturing techniques to provide structural members for a side wall assembly. Manufacturing procedures associated with thermoplastic materials and insulating foam may be modified in accordance with teachings of the present invention to form other portions of composite box structure 30.

Various features of a roof assembly and an airflow management system formed in accordance with teachings of the present invention will be described with respect to temperature controlled railway car 20. However, for some applications a roof assembly incorporating teachings of the present invention may be attached to or mounted on a conventional box car or refrigerated railway car during repair and/or rebuilding. In a similar manner all or portions of an air plenum assembly incorporating teachings of the present invention may be installed within a conventional insulated box car or conventional refrigerated box car during repair and/or rebuilding of the box car. A roof assembly and an airflow management system incorporating teachings of the present invention are not limited to use with temperature controlled railway car 20.

For embodiments of the present invention as shown in FIGS. 1A–4 portions of railway car underframe 200 may be manufactured and assembled using conventional railcar manufacturing procedures and techniques. Railway car underframe 200 includes a pair of railway car trucks 202 and 204 located proximate to each end of railway car underframe 200. Standard railcar couplings 210 are also provided at each end of railway car underframe 200. Each coupling 210 preferably includes end of car cushioning unit 212 disposed at each end of an associated center sill (not expressly shown). Railway car underframe 200 preferably includes a plurality of longitudinal stringers 230.

Figure 3:
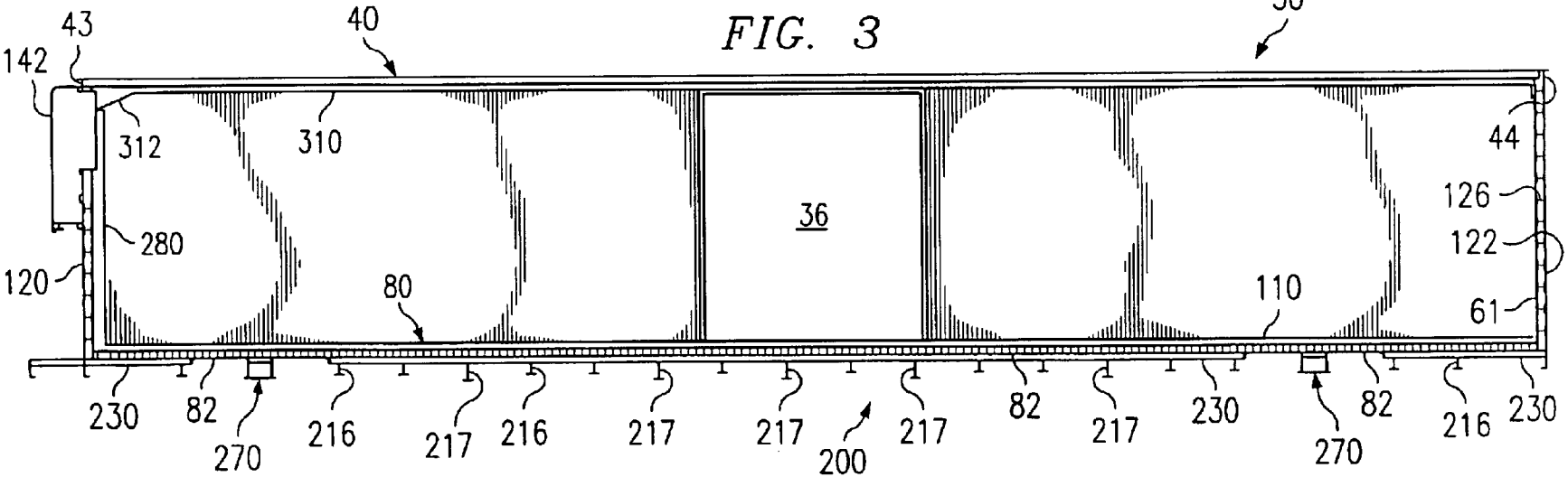
FIG. 3 is a schematic drawing in section with portions broken away taken a long lines 3—3 of FIG. 1B showing interior portions of a composite box structure formed in accordance incorporating teachings of the present invention.

For the embodiment of the present invention as shown in FIGS. 1A–4 railway car underframe 200 preferably includes a plurality of longitudinal stringers 230 which extend approximately the full length of railway car underframe 200. As shown in FIG. 3, railway car underframe 200 may include cross tie 216 and cross bearers 217 with longitudinal stringers 230 disposed thereon. Cross ties 216 and cross bearers 217 are attached to and extend laterally from center sill 214. Longitudinal stringers 230 are preferably disposed on cross ties 216 and cross bearers 217 and extend parallel with center sill 214. Cross ties 216 and cross bearers 217 are generally spaced laterally from each other extending from center sill 214. The number of cross ties, cross bearers and longitudinal stringers may be varied depending upon the desired load carrying characteristics for the resulting railway car 20.

Railway car underframe 200 also includes side sill assemblies 250 and 252 and end sill assemblies 220 and 222. Side wall assemblies 50 and 52 may be fabricated with respective side sill assemblies 250 and 252 formed as integral components thereof. End wall assemblies 120 and 122 may also be fabricated with all or portions of respective end sill assemblies 220 and 222 formed as integral components thereof.

Side wall assemblies 50 and 52 have substantially the same configuration and overall design. Therefore, various features of composite box structure 30 will be discussed primarily with respect to side wall assembly 50. See FIG. 2. Side wall assembly 50 includes a plurality of metal side sheets 54 disposed on the exterior of composite box structure 30. Exterior surfaces 53 of side sheets 54 cooperates with each other to form the exterior of side wall assembly 50. See FIG. 1A. A plurality of support posts or side stakes 56 may be attached to portions of interior surface 55 of each side sheet 54. Support posts 56 extend towards interior 32 of composite box structure 30.

For some applications, isolator 60 formed from a thermoplastic polymer such as polyvinyl chloride (PVC) insulating material may be attached to interior surface or first surface 57 of each support post 56. For other applications alternating blocks of PVC and blocks of insulating foam (not expressly shown) may be placed on first surface 57 of each support post 56. Various thermoplastic polymers, urethane foams and other types of insulating material may also be attached to first surface 57 of each support post 56 to form isolators 60. The present invention is not limited to use of PVC strips.

First layer 61 of polymeric material or FRP material may then be attached to isolators 60. Foam insulation 58 may be disposed between adjacent support posts 56 and bonded with interior surface 55 of side sheets 54 and the interior surface of first layer 61 and adjacent portions of support posts 56. For some applications a layer of scrim (not expressly shown) may be attached to the interior surface of first layer 61 to enhance bonding with foam insulation 58. Second layer 62 of polymeric material or FRP material may be attached to first layer 61.

First layer 61 and second layer 62 are preferably formed from tough, light weight, rigid material having high impact resistance. First layer 61 and second layer 62 cooperate with each other to form a liner for composite box structure 30. For some applications first layer 61 and second layer 62 are preferably formed from Bulitex material available from U.S. Liner Company, a division of American Made, Inc. Bulitex material may be generally described as a ballistic grade composite scuff and wall liner.

Various types of ballistic resistant fabric may be satisfactorily used to form a liner for a composite box structure in accordance with teachings of the present invention. Ballistic resistant fabrics are often formed with multiple layers of woven or knitted fibers. The fibers are preferably impregnated with low modulus elastomeric material as compared to the fibers which preferably have a high modulus. U.S. Pat. No. 5,677,029 entitled "Ballistic Resistant Fabric Articles, and assigned to Allied Signal shows one example of a ballistic resistant fabric. First layer 61 and/or second layer 62 may be formed from other materials including fiber reinforced plastics, thermoplastics, polymers and copolymers.

Second layer 62 preferably includes a corrugated cross section which provides desired airflow paths 63 when lading is disposed adjacent to side wall assembly 50. Airflow paths 63 form portions of airflow management system 300.

For one application side sheets 54 may be formed from twelve (12) gauge steel. Support post 56 may be three (3)

inch I beams. Isolators 60 may have dimensions of approximately two (2) inches by two (2) inches by three fourths (¾) of an inch. Foam insulation 58 may have a thickness of approximately four (4) inches. First layer 61 may be formed from Bulitex material having a thickness of approximately 0.06 inches. Second layer 62 may be formed from Bulitex material having a thickness of approximately 0.04 inches. The width of each corrugation formed in second layer 62 may be between approximately four (4) and five (5) inches. The corrugations form airflow path 63 spaced approximately one half (½) inch from first layer 61.

Figure 4:
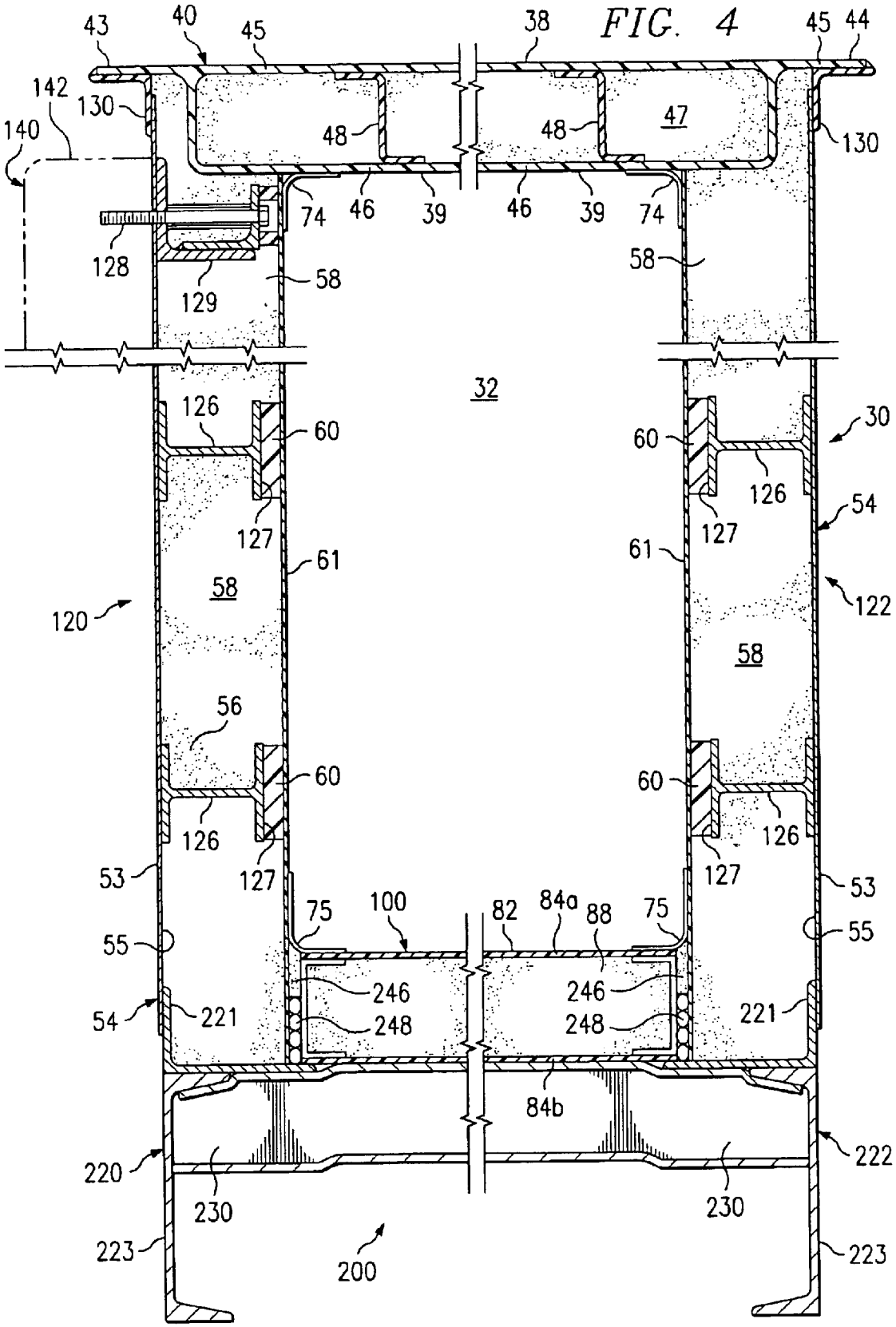
FIG. 4 is a schematic drawing in section with portions broken away showing selected features of a roof assembly, end wall assemblies and a floor assembly forming a composite box structure in accordance with teachings of the present invention.

End wall assemblies 120 and 122 may be formed using similar materials and techniques as described with respect to side wall assembly 50. In side wall assembly 50, support posts 56 extend generally vertically between side sill assembly 250 and associated top chord 64. See FIG. 10. End wall assemblies 120 and 122 may also be formed from 1 beams (sometimes referred to as "end beams") having configurations similar to support posts 56. However, I beams or end beams 126 disposed within end wall assemblies 120 and 122 preferably extend generally horizontally with respect to each other and railway car underframe 200. For the embodiment of the present invention as shown in FIG. 4, end wall assemblies 120 and 122 include a plurality of end beams 126 respectively attached with metal sheets 54 and spaced from each other extending generally horizontally relative to floor assembly 80 and railway car underframe 200. Metal sheets 54 may sometimes be referred to as "end sheets" when attached to end wall assemblies 120 and 122.

Respective isolators 60 may be attached to interior surface or first surface 127 of each end beam 126. First layer 61, a polymeric material, may then be attached to isolators 60. Foam insulation 58 may be disposed between and bonded with adjacent portions of end beams 126 interior surface 53 of metal sheets 54 and adjacent portions of first layer 61. For purposes of illustrating various features of the present invention, portions of end wall assemblies 120 and 122 are shown with foam insulation 58 disposed therein. For most applications, end wall assemblies 120 and 122 will be filled with foam insulation 58 between respective first layer 61 and respective metal sheets 54.

For the embodiment of the present invention as shown in FIG. 4, portions of end sill assemblies 220 and 222 are formed as integral components of respective end wall assemblies 120 and 122. For one embodiment respective angles 221 may be securely attached with respective metal sheets 54 and bonded with associated foam insulation 58. End sill assemblies 220 and 222 may also include respective C shaped channels 223. The length of C shaped channels 223 approximately equals the width of railway car underframe 200 and the exterior width of composite box structure 30. The respective ends of each longitudinal stringer 230 are preferably formed to receive portions of respective C shaped channels 223 and portions of respective angles 221. Various welding techniques and/or mechanical fasteners may be satisfactory used to couple metal sheets 54 with respective angles 221, angles 221 with respective C shaped channels 223 and end sill assemblies 220 and 222 with respective ends of longitudinal stringers 230.

For some applications a plurality of pultruded panels 82 (see FIGS. 4, 5 and 6) may be bonded with each other to form primary floor 100 having a generally rectangular configuration corresponding with the desired interior length and width of composite box structure 30. The length of each pultruded panel 82 may correspond approximately with the interior width of composite box structure 30. U.S. Pat. No. 5,716,487 entitled "Pultrusion Apparatus" assigned to Creative Pultrusion, Inc. describes one example of equipment and procedures which may be used to form pultrusion panels 82.

After the desired number of pultruded panels 82 have been bonded with each other, the resulting primary floor 100 may be lowered from above between side wall assemblies 50 and 52 until primary floor 100 engages longitudinal stringers 230 and portions of side sills 250 and 252 (not expressly shown) and end sill assemblies 220 and 222. See FIG. 4. For other applications, primary floor 100 may be attached with railway car underframe 200 prior to attaching side wall assemblies 50 and 52. End wall assemblies 120 and 122 may then be mounted on and attached to railway car underframe 200. Next, roof assembly 40 may be mounted on and attached with side wall assemblies 50 and 52 and end wall assemblies 120 and 122 opposite from primary floor 100. See FIGS. 3, 4 and 5.

For some applications selected portions of primary floor 100 may be adhesively bonded or securely attached with adjacent portions of railway car underframe 200. Other portions of primary floor 100 which are not bonded with railway car underframe 200 may expand and contract relative to longitudinal stringers 230 as temperature changes occur within composite box 30. For some applications restraining anchor assemblies 270 may be attached with adjacent portions of primary floor 100 and longitudinal stringers 230 to allow limited longitudinal movement of floor assembly 80 relative to railway car underframe 200 and substantially restrict vertical movement of floor assembly 80 relative to railway car underframe 200 during thermal expansion and contraction. See FIG. 3.

Figure 5:
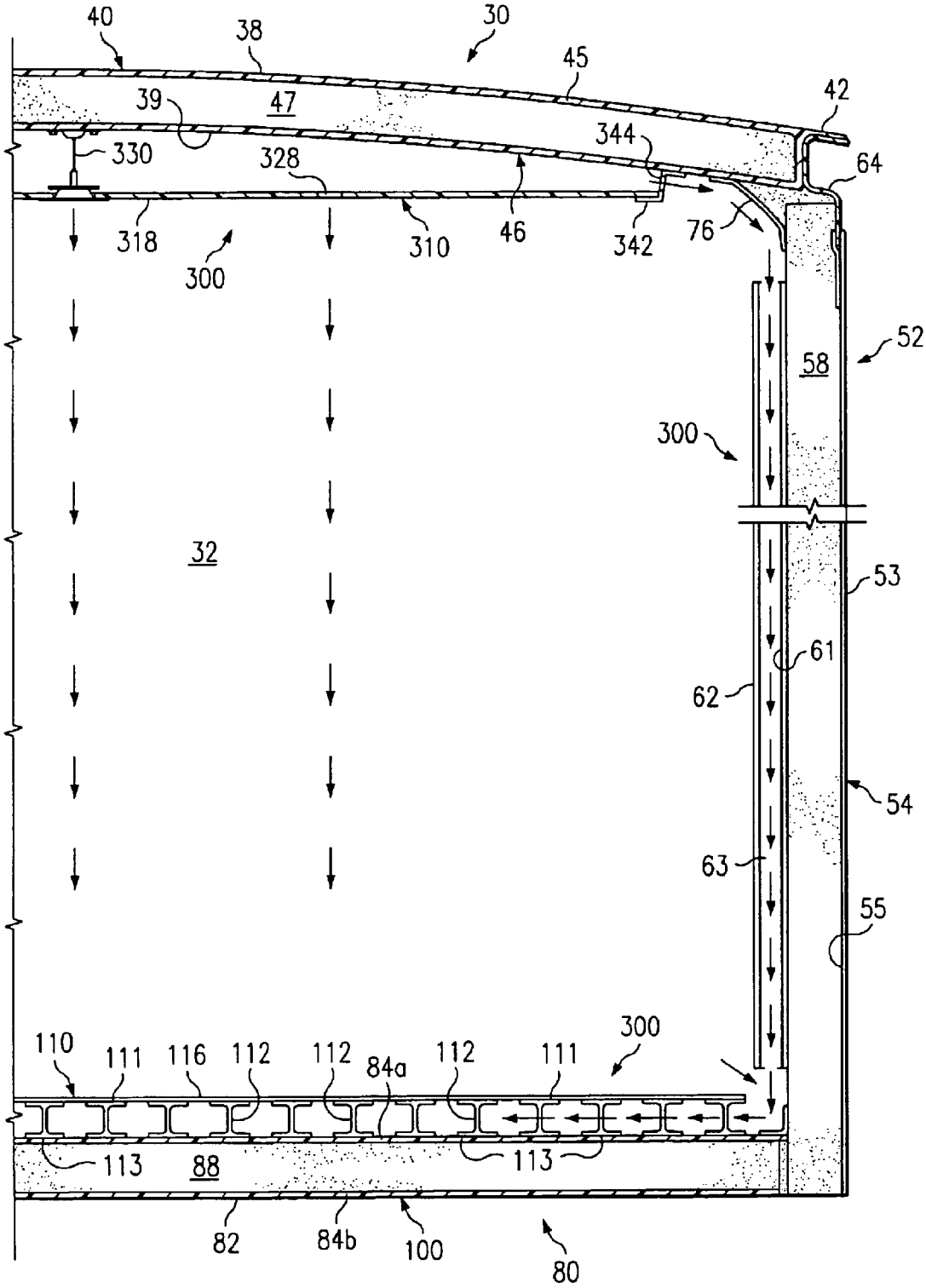
FIG. 5 is a schematic drawing in section with portions broken away taken along lines 5—5 of FIG. 3 showing portions of an airflow management system formed within a composite box structure incorporating teachings of the present invention.
Figure 6:
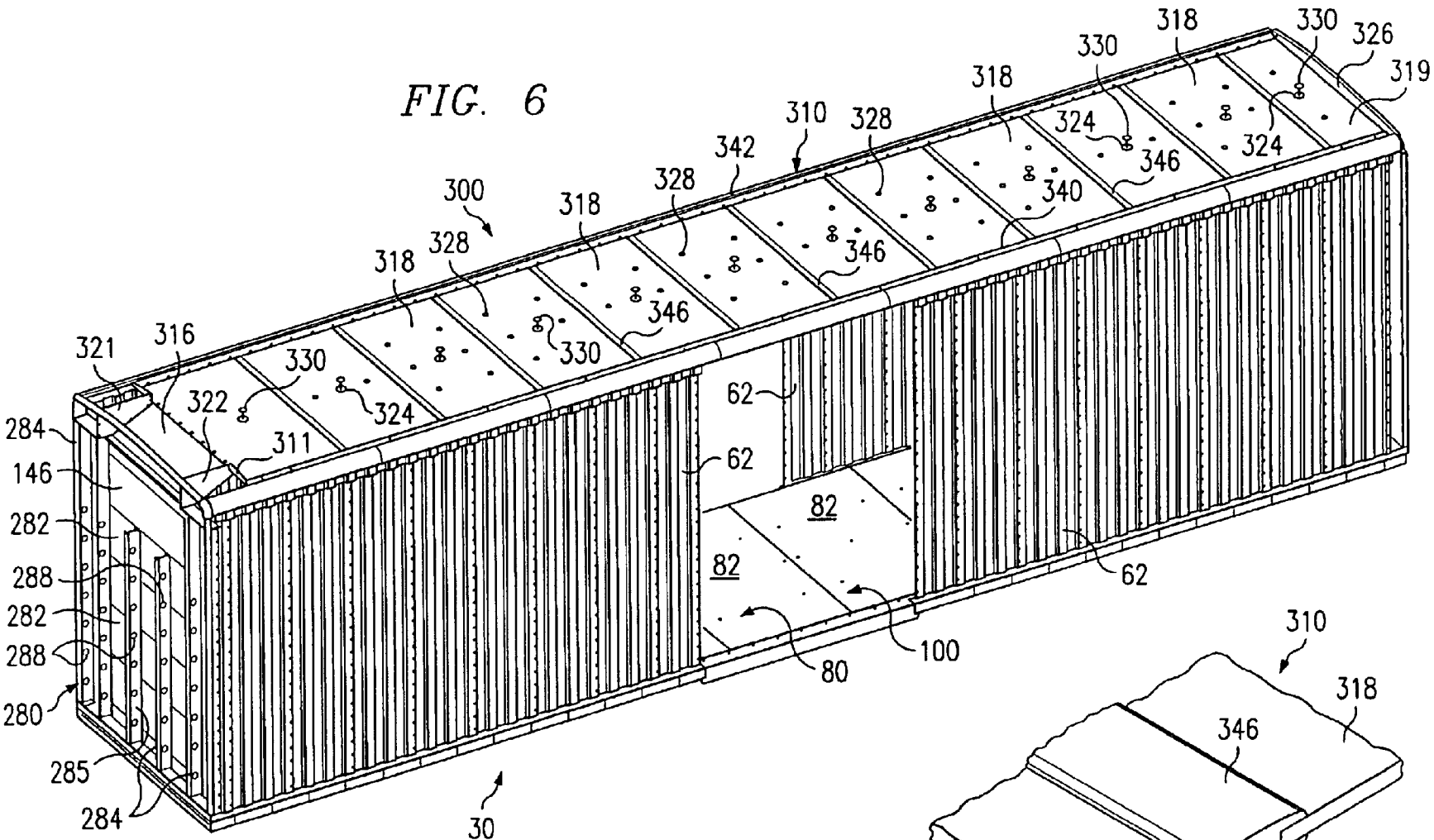
FIG. 6 is a schematic drawing showing an isometric view with portions broken away of a composite box structure having an airflow management system formed in accordance with teachings of the present invention.
Figure 8:
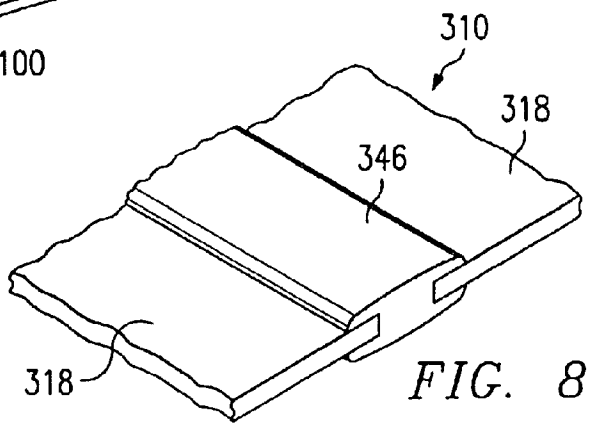
FIG. 8 is a schematic drawing showing an isometric view with portions broken away of two plenum panels coupled with each other in accordance with teachings of the present invention.

As shown in FIGS. 5 and 6 floor assembly 80 preferably includes primary floor 100 and secondary floor 110. Secondary floor 110 may be formed by placing a plurality of support beams 112 on pultruded panels 82 opposite from railway car underframe 200. Each support beam 122 may have a configuration or cross section corresponding with a typical I beam. A plurality of deck plates or coverings 116 may be placed on first surface 111 of each support beam 112. Second surface 113 of each support beam 112 may be adhesively bonded or coupled with adjacent portions of pultruded panels 82. Deck plates 116 may be adhesively bonded or coupled with first surface 111 of each support beam 112. Alternatively, all or some deck plates 116 may be mechanically fastened with support beams 112 using various types of mechanical fasteners such as bolts, rivets and/or HUCK fasteners (not expressly shown). Support beams 112 and deck plates 116 may be formed from metal alloys or other materials typically associated with forming a floor.

A plurality of openings (not expressly shown) may be formed in each support beam 112 to enhance airflow or air circulation between primary floor 100 and secondary floor 110. As shown in FIG. 5, airflow paths formed between primary floor 100 and secondary floor 110 provide a portion of airflow management system 300.

Roof assembly 40 may be formed with a generally elongated, rectangular configuration. The length and width of roof assembly 40 corresponds generally with desired length and width of resulting composite box structure 30. Roof assembly 40 includes first longitudinal edge 41 and second longitudinal edge 42 spaced from each other and extending generally parallel with each other from first lateral edge 43 to second lateral edge 44. Roof assembly 40 may have a generally arcuate configuration extending from first longitudinal edge 41 to second longitudinal edge 42. See FIGS. 5 and 10. Longitudinal edges 41 and 42 are preferably mounted on and attached with respective side wall assemblies 50 and 52. See FIGS. 5 and 10. Lateral edges 43 and 44 are preferably mounted on and attached with respective top plates 130 of end wall assemblies 120 and 122. See FIG. 4.

Figure 10:
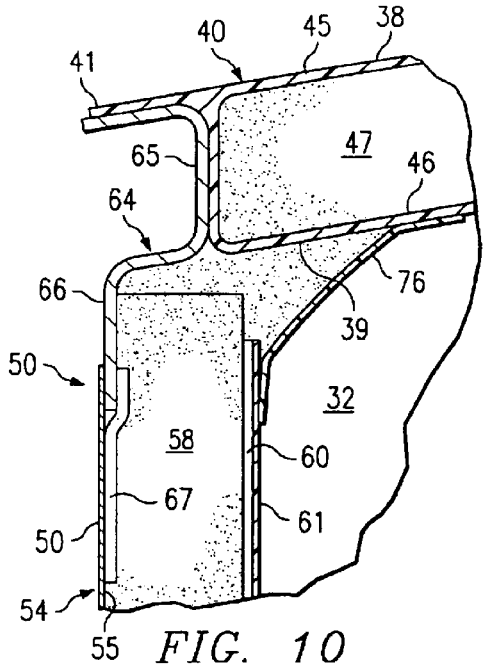
FIG. 10 is a schematic drawing in section with portions broken away showing a typical flexible joint or flexible connection formed between a roof assembly and a side wall assembly in accordance with teachings of the present invention.

Various types of composite materials and insulating materials may be satisfactory used to form a roof assembly incorporating teachings with the present invention. For the embodiment of the invention as shown in FIGS. 4, 5 and 10, roof assembly 40 may be formed from one or more FRP layers 45 and 46. Each FRP layer may be formed from multiple panels or sheets of FRP. For the embodiment shown in FIG. 4, FRP layer 45 provides outer surface 38 of roof assembly 40. FRP layer 46 provides interior 39 surface of roof assembly 40. The number of FRP layers may be varied depending upon the planned use of resulting roof assembly 40.

FRP layers 45 and 46 are preferably bonded with each other to encapsulate insulating layer 47 therebetween. For some applications insulating layer 47 may be formed from the same materials used to form foam insulation 58. However, any material having desired thermal insulating characteristics may be satisfactory used to form insulating layer 47.

A plurality of generally Z shaped beams or stiffeners 48 may be disposed within roof assembly 40 between FRP layers 45 and 46. For some applications stiffeners 48 preferably extend laterally from first longitudinal edge 41 to second longitudinal 42 of roof assembly 40. Stiffeners 48 may be spaced from each other throughout the length of roof assembly 40. Various types of adhesive and/or fasteners may be satisfactory used to attach stiffeners 48 with adjacent portions of FRP layers 45 and 46. For some applications resins associated with vacuum infusion of roof assembly 40 may also be used to bond stiffeners 47 with FRP layers 45 and 46.

The perimeter of roof assembly 40 may include multiple layers of FRP material to provide appropriate strength required to adhesively bond with respective portions of side wall assemblies 50 and 52 and end wall assemblies 120 and 122. Strips of trim molding 74 are preferably bonded with and attached to roof assembly 40 at respective flexible joints with end wall assemblies 120 and 122. Strips of trim molding 75 are preferably bonded with and attached to end wall assembly 120 and 122 at respective flexible joints with primary floor 100. See FIG. 4.

Trim moldings 76 are preferably bonded with and attached longitudinally along respective flexible joints formed between roof assembly 40 and side wall assemblies 50 and 52. See FIGS. 5 and 10. Trim molding 74, 75 and 76 accommodate limited expansion and contraction of respective flexible joints and flexible connects associated with composite box structure 30 while at the same time maintaining desired structural integrity of interior 32. An example of trim molding 76 is shown in FIG. 10. Various types of FRP materials may be satisfactory used to form trim molding 74, 75 and 76. Door assemblies 180 may be slidably mounted on side wall assemblies 50 and 52 to control access to interior 32 through respective openings 36.

Temperature control system 140 preferably includes refrigeration unit or cooling unit 142 and airflow management system 300 to provide substantially uniform, constant airflow around and through lading carried within composite box structure 30. For some applications such as transporting products in sub-zero, winter environments temperature control system 140 may include a heater. Refrigeration unit 142 may be a self-contained refrigeration unit including a compressor (not expressly shown), a condenser (not expressly shown), airflow blowers (not expressly shown), an external fuel tank 219 and a diesel engine (not expressly shown). For some applications, refrigeration unit 142 may provide airflow in the range of 3200 CFM. Self-contained refrigeration unit 142 provides the advantage of easier and faster maintenance as compared to conventional refrigerated box cars with similar performance characteristics. As a result, temperature control system 140 generally lowers maintenance time and costs and increases the amount of time that temperature controlled railway car 20 remains in service between repairs.

Refrigeration unit 142 may be a programmable unit able to control and maintain desired temperatures within composite box structure 30. Refrigeration unit 142 may include a keypad (not expressly shown) for inputting data for desired system performance and a microprocessor to control and monitor the functions and performance of refrigeration unit 142 and temperature control system 140. Refrigeration unit 142 may also include a satellite monitoring and control system (not expressly shown) and/or cellular technology to transmit to remote locations information such as the performance and location of refrigeration unit 142 or the temperature inside composite box structure 30. Various types of refrigeration systems are commercially available from companies such as Thermo King and Carrier. Such units are frequently used in motor carrier trailers and other large containers.

As shown in FIGS. 1A and 1B, refrigeration unit 142 may be mounted on end wall assembly 120. Refrigeration unit 142 may be mounted on the exterior of end wall assembly 120 using mounting bolts 128 and associated supports 129 disposed within end wall assembly 120. The number of mounting bolts 128 may be varied depending on the size and weight of associated refrigeration unit 142.

End platform system 260 may be coupled to railway car underframe 200 near refrigeration unit 142 to provide access to refrigeration unit 142. External fuel tank 219 may be located proximate to refrigeration unit 142. This provides the benefit of convenient access to both fuel tank 219 and refrigeration unit 142.

Airflow management system 300 provides relatively uniform distribution of air at a desired temperature throughout the length, width and height of interior 32 of composite box structure 30. Airflow management system 300 allows cooled air to circulate from refrigeration unit 142, around and through products or lading contained within composite box structure 30, and back to refrigeration unit 142. Airflow management system 300 may also be capable of circulating fresh air from outside composite box structure 30 or heated air throughout the interior portion of composite box structure 30.

Depending on the intended application for composite box structure 30 and associated railway car, refrigeration unit 142 may or may not be used in conjunction with airflow management system 300. Also, because of superior insulating characteristics of composite box structure 30, refrigeration unit 142 may not be necessary for particular products and operating environments, to maintain satisfactory temperature regulation of some types of products within composite box structure 30. For these applications, satisfactory air temperatures may be maintained within composite box structure 30 either without using temperature control system 140, or by using only airflow management system 300 to circulate fresh air throughout composite box structure 30.

The present invention provides benefits of a more diverse box car having the capability of transporting a wide variety of freight, including frozen products, fresh products, dry food or non-food products which do not require refrigeration or temperature control.

Airflow management system 300 includes a number of features which keep products shipped within composite box structure 30 spaced from the interior surfaces of the side wall assemblies 50 and 52, end wall assemblies 120 and 122, and primary floor 100 to create openings or gaps for airflow around the products. These features include air plenum assembly 310, secondary floor 110, interior bulkhead or end barrier 280, and corrugations or airflow paths 63 formed by second layer 62. Some features of airflow management system 300 may slightly reduce volumetric carrying capacity of composite box structure 30. However, improved airflow around and through products shipped inside composite box structure 30 achieves desired temperature regulation of such products and more than compensates for any volumetric reduction.

Airflow management system 300 includes air plenum assembly 310. See FIGS. 3, 5, 6, 7A and 7B. Air plenum assembly 310 may be coupled with temperature control unit 142 to provide portions of an airflow path to supply air from temperature control unit 142 to interior 32 of composite box structure 30. Air plenum assembly 310 has a generally elongated, rectangular configuration. The length of air plenum assembly 310 is approximately equal to the interior length of composite box structure 30. The width of air plenum assembly 310 is generally less than the interior width of composite box structure 30. See FIGS. 5 and 6.

Figure 12:
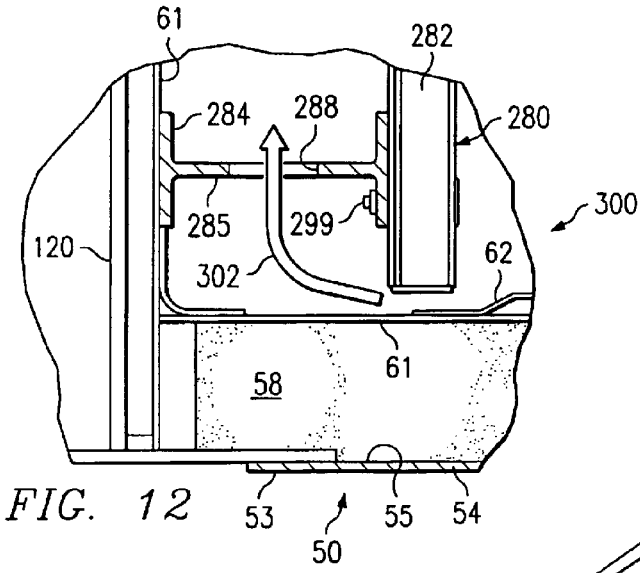
FIG. 12 is a schematic drawing in section with portions broken away showing portions of an airflow path formed between an interior bulkhead and an end wall assembly incorporating teachings of the present invention.
Figure 11:
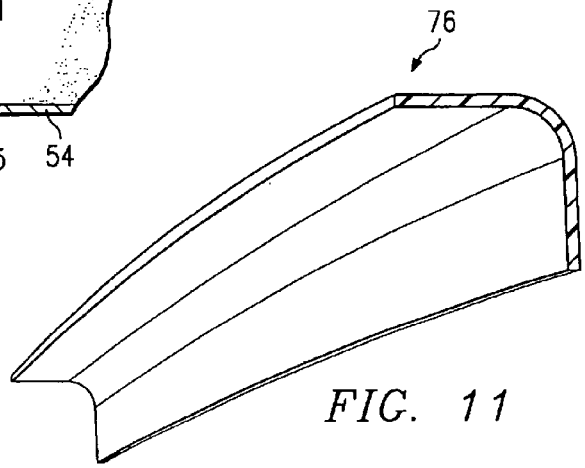
FIG. 11 is a schematic drawing showing an isometric view with portions broken away of trim molding satisfactory for use in forming portions of a flexible joint or flexible connection between a roof assembly and a side wall assembly in accordance with teachings of the present invention.

Interior bulkhead or end barrier 280 may be formed within composite box structure 30 adjacent to end wall assembly 120. For the embodiment of the present invention as shown in FIGS. 6 and 12, interior bulkhead 280 may be formed by attaching a plurality of support beams 284 and a plurality of panels 282 with each other. Various types of supporting structures other than support beams 284 may be used to form interior bulkhead 280.

For one application support beams 284 have a cross section corresponding with a conventional I beam. Each support beam preferably includes a respective web 285 with a plurality of openings 288 formed therein. Openings 288 allow increased circulation of airflow between interior bulkhead 280 and adjacent portions of end wall assembly 120.

Panels 282 may be attached to or mounted on support beams 284 using various techniques such as adhesive and/or mechanical fasteners. A portion of mechanical fastener 299 used to attach panel 282 with support beam 284 is shown in FIG. 12. For some applications panels 282 may be formed, using pultrusion techniques, with a plurality of slots (not expressly shown). Attaching inserts (not expressly shown) may be disposed within one or more slots for use in attaching each panel 282 with associated support beams 284.

Opening 146 is preferably formed in interior bulkhead 280 to provide access to refrigeration unit 142. See FIG. 6. Also, a panel or door (not expressly shown) may be hinged adjacent to opening 146 to control and limit access to refrigeration unit 142. Air flowing between primary floor 100 and secondary floor 110 is preferably directed towards the lower portion of interior bulkhead 280 and then flows upward between support post 284 to return to refrigeration unit 142. As shown in FIG. 12 interior bulkhead 282 is preferably spaced from adjacent portions of side wall assemblies 50 and 52. Arrow 302 represents air flowing between interior barrier 280 and adjacent portions of side wall assembly 50 and through opening 288 in web 285.

Plenum panels 318 and 319 preferably have respective openings 324 formed therein and extending through at approximately the center of each panel. Openings 324 will be discussed later with respect to hanger assemblies 30. Additional openings 328 may also be formed in plenum panels 318 and 319 to allow limited airflow from air plenum assembly 310 to interior 32 of composite box structure 30. The number of openings 328 and the pattern of openings 328 formed in each plenum panel 318 and 319 may be varied depending upon desired airflow characteristics and/or the type of lading which will be carried within railway car 20.

Longitudinal connectors 340 and 342 are preferably disposed along opposite sides of air plenum assembly 310 extending from first end 311 to second end 326. Connectors 340 and 342 may be attached to or bonded with the respective longitudinal edge of air plenum assembly 310 and adjacent portions of roof assembly 40. See FIG. 5. A plurality of openings 344 may be formed in each longitudinal connector 340 and 342 to allow limited airflow from air plenum assembly 310 outwardly towards adjacent side wall assemblies 50 and 52. The number, size and location of openings 344 may be varied to provide desired airflow from air plenum assembly 310 to flow paths 63 formed by corrugations associated with respective side wall assemblies 50 and 52. See FIG. 5.

Respective plenum panels 318 are generally disposed immediately adjacent to each other. A respective connector 346 is preferably coupled with adjacent longitudinal edges of each plenum panel 318. See FIG. 8. In addition to providing support for air plenum assembly 310, connectors 346 prevent undesired airflow between adjacent plenum panels 318.

Figures 7A, 7B:
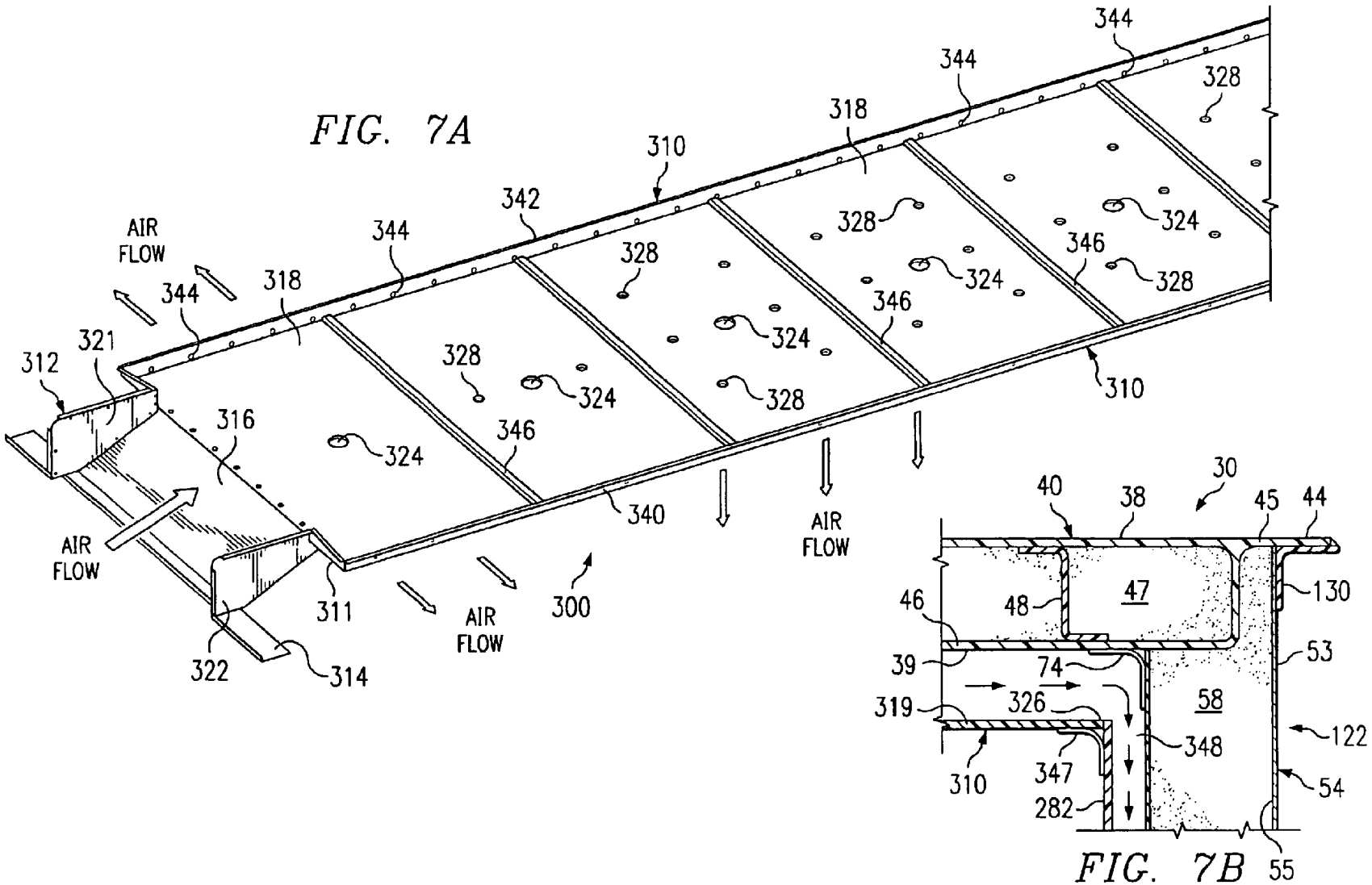
FIG. 7A is a schematic drawing showing an isometric view with portions broken away of an air plenum assembly incorporating teachings of the present invention.
FIG. 7B is a schematic drawing in section with portions broken away showing one end of an air plenum assembly coupled with airflow paths formed on an interior surface of an adjacent end wall assembly.

As shown in FIG. 7B, second end 326 of air plenum assembly 310 may be coupled with a plurality of airflow paths formed along the interior of end wall assembly 122. Airflow paths 348 may be formed on the interior surface of end wall assembly 122 using various techniques. For some applications second layer 62 may be attached to end wall assembly 122 to provide airflow paths 348. For other applications a plurality of extruded panels 282, having a plurality of slots formed therein, may be attached with end wall assembly 122. Pultruded panels 282 are preferably oriented with respective slots extending generally vertically between air plenum assembly 310 and floor assembly 80 to provide airflow paths 348. As a result, an airflow path may be provided from second end 326 of air plenum assembly 310 through airflow paths 348 formed on the interior of end wall assembly 122 and into the space formed between primary floor 100 and secondary floor 110. Trim molding 347 may also be attached adjacent to second end 326 of air plenum assembly 310 and airflow path 348.

Chute assembly 312, attached to first end 311 of air plenum assembly 310, provides an airflow path from temperature control unit 142 to air plenum assembly 310. Chute assembly 312 preferably includes one or more supports 314 which may be disposed on and attached to an upper portion of interior bulkhead 280 adjacent to temperature control unit 142. Transition panel 316 may be attached with support 314 extending at an angle from adjacent portions of interior bulkhead 280 to air plenum assembly 310. First side panel 321 and second side panel 322 are respectively attached to opposite edges of transition panel 316 to further direct airflow from temperature control unit 142 to air plenum assembly 310. Support 314, panel 316 and side panels 321 and 322 may be formed from aluminum or other satisfactory lightweight material. Chute assembly 312 may be described as a chute assembly with respect to temperature control unit 142 or as an inlet chute with respect to air plenum assembly 310.

Air plenum assembly 310 may be formed from a plurality of plenum panels 318. Each plenum panel 318 may have substantially the same overall configuration and dimensions. For some applications plenum panel 319 with a reduced width as compared with plenum panels 318 may be disposed at second end 326 of air plenum assembly 310 opposite from chute assembly 312.

Plenum panels 318 and 319 preferably have a generally rectangular configuration. Plenum panels 318 and 319 may be formed from a variety of FRP materials and/or lightweight metals. For some applications plenum panels 318 and 319 may be formed from Bulitex material similar to the material used to form first layer 61 and second layer 62.

Figure 9:
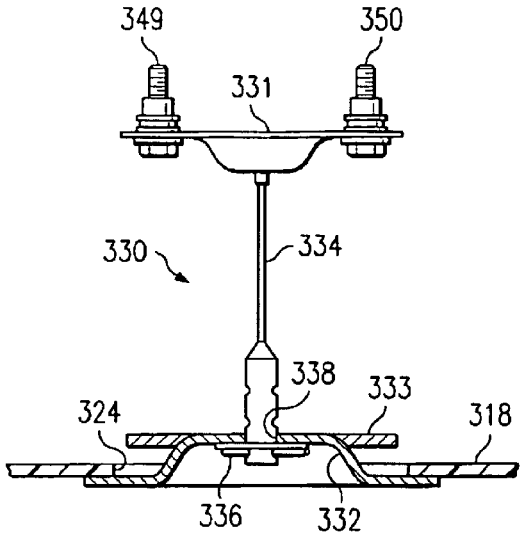
FIG. 9 is a schematic drawing, in section and in elevation with portions broken away, showing a hanger assembly formed in accordance with teachings of the present invention for attaching a plenum panel with a roof assembly.

A respective hanger assembly 330 may be used to attach each plenum panel 318 and plenum panel 319 with interior surface 39 of roof assembly 40. Each hanger assembly 330 preferably includes first support 331 and second support 332. Flexible cable assembly 334 may be securely engaged with first support 331 and releasably engaged with second support 332. For the embodiment of the present invention as shown in FIG. 9, opening 338 is preferably formed within second support 332. A portion of flexible cable assembly 334 may be inserted through opening 338. Pin 336 may be inserted through another opening formed in flexible cable anchor assembly 334 to releasably engage second support 332 with flexible cable assembly 334.

Hanger assembly 330 may also include third support 333. Third support 333 is preferably spaced from second support 332 such that portions of associated plenum panel 318 may be disposed therebetween. For the embodiment of the present invention as shown in FIG. 9, first support 331, second support 332, and third support 333 may have a generally circular, disk shaped configuration. A pair of mechanical fasteners 349 and 350 may be used to attach first support 331 with interior surface 39 of roof assembly 40. For some applications, hanger assemblies 330 are preferably disposed along the longitudinal center line of roof assembly 40. For other applications, the number and location of hanger assemblies 330 may be varied depending upon the desired configuration of the associated air plenum assembly. The exterior dimensions of third support 333 are preferably smaller than the diameter of opening 324 in the associated plenum panel 318.

Fasteners 349 and 350 may be used to attach the respective first support 331 at a desired location on interior surface 39 of roof assembly 40. Pin 336 may be removed from flexible cable assembly 334 to release second support 332 and third support 333 therefrom. The associated plenum panel 318 may then be positioned with a portion of flexible cable assembly 334 extending through respective opening 324. The portion of flexible cable anchor assembly 334 may then be inserted through opening 338 in second support 332 and pin 336 inserted therein. As a result, plenum panel 318 will be disposed between second support 332 and third support 333.

Flexible cable assembly 334 including second support 332 and third support 333 allows limited movement or flexing of plenum panels 318 and 319 relative to each other. For example, during loading and/or unloading of composite box structure 30, plenum panels 318 may be raised or moved upwardly if contacted by a fork lift or other equipment used to load composite box structure 30. Allowing limited movement of plenum panels 318 and 319 relative to each other and roof assembly 40 substantially reduces maintenance requirements associated with air plenum assembly 310.

One temperature controlled railway car formed in accordance with teachings of the present invention has the following features:

286,000 lb. Gross Rail Load;

Standard car equipped with 10'-0" wide by 11'-3½" high insulated single plug door;

15" end-of-car cushioning unit;

Meets AAR Plate "F" Clearance Diagram;

State-of-the art temperature control unit, exterior service platform and interior access door;

Satellite monitoring and control system;

An airflow management system installed in the interior of the composite box structure;

High performance insulating materials;

Durable, wood free interior materials; and

No ferrous metals in the interior.

| | |
|---|---|
| Length Inside | 72'-2" |
| Length Over Coupler Pulling Faces | 82'-2" |
| Length over Strikers | 77'-10" |
| Length Between Truck Centers | 52'-0" |
| Truck Wheel Base | 5'-10" |
| Width, Extreme | 10'-6⅝" |
| Width, Inside | 9'-2" |
| Height, Extreme | 16'-11⅞" |
| Height Inside at Center Line of Car | 12'-1½" |
| Estimated Lightweight | 105,000 lbs. |
| Estimated Load Limit - Based on 286,000 lbs. Gross Rail Load | 181,000 lbs. |
| Gross Rail Load | 286,000 lbs. |
| Cubic Capacity (Between bulkheads) | 8,012 cubic feet |
| Cubic Capacity (Level with height of sides) | 7,883 cubic feet |

Although the present invention and its advantages have been described in detail, it should be understood that various changes, substitutions and alternations can be made herein without departing from the spirit and scope of the invention as defined by the following claims.

What is claimed is:

1. A composite box structure mounted on a railway car underframe comprising:

a floor assembly mounted on and attached to the railway car underframe;

a pair of side wall assemblies and a pair of end wall assemblies attached to the floor assembly and the railway car underframe;

each side wall assembly and each end wall assembly having an exterior surface formed from a plurality of metal sheets;

foam insulation bonded with interior surfaces of the metal sheets;

a temperature control unit mounted on one of the end wall assemblies;

a roof assembly attached to and coupled with the side wall assemblies and the end wall assemblies opposite from the floor assembly;

an air plenum assembly attached to and extending from an interior surface of the roof assembly;

an interior bulkhead disposed adjacent to and spaced from the one end wall assembly to provide portions of an airflow path to return air from an interior of the composite box structure to the temperature control unit; and a first end of the air plenum assembly coupled with a portion of the interior bulkhead to provide portions of an airflow path to supply air from the temperature control unit to the interior of the composite box structure.

2. The composite box structure of claim 1 wherein the air plenum assembly further comprises:

a plurality of plenum panels disposed adjacent to each other and respectively attached with the roof assembly; and a chute assembly forming a portion of the air supply flow path from the temperature control unit to the air plenum assembly.

3. The composite box structure of claim 2 wherein the chute assembly further comprises:

a first support disposed on and attached with an upper portion of the interior bulkhead;

a transition panel attached with the first support and extending at an angle between the upper portion of the interior bulkhead and the air panel assembly; and a first side panel and a second side panel respectively attached to opposite edges of the transition panel to direct airflow from the temperature control unit to the air plenum assembly.

4. The composite box structure of claim 2 further comprising a respective hanger assembly disposed between each plenum panel and the roof assembly.

5. The composite box structure of claim 1 wherein the floor assembly further comprises a primary floor and a secondary floor with an airflow path formed between the secondary floor and the primary floor to provide portions of an airflow path for supplying air to the interior of the composite box structure.

6. The composite box structure of claim 1 further comprising;

each side wall assembly having an interior surface defined in part by a plurality of fiber reinforced plastic layers; and the fiber reinforced plastic layers having a generally corrugated cross section which provide portions of airflow paths for supplying air to the interior of the composite box structure.

7. The composite box structure of claim 1 further comprising an airflow coupling extending between a second end of the air plenum assembly and at least one airflow path disposed on an interior surface of the other end wall assembly.

8. The composite box structure of claim 1 wherein the air plenum assembly further comprises:

a plurality plenum panels; and openings formed in the plenum panels to allow controlled airflow from the air plenum assembly to the interior of the composite box structure.

9. A roof assembly for a railway car comprising:

the roof assembly having a generally elongated, rectangular configuration;

an air plenum assembly attached to and extending from an interior surface of the roof assembly;

the air plenum assembly operable to receive air from a temperature control unit and to provide portions of an airflow path from the temperature control unit;

the air plenum assembly formed in part by a plurality of plenum panels disposed adjacent to each other; and respective hanger assemblies attaching the plenum panels with the roof assembly.

10. The roof assembly of claim 9 further comprising a seal formed between adjacent plenum panels.

11. The roof assembly of claim 9 further comprising the hanger assemblies spaced from each other and extending along a longitudinal centerline of the roof assembly.

12. The roof assembly of claim 9 further comprising:

a first longitudinal edge and a second longitudinal edge spaced from each other and extending from a first lateral edge to a second lateral edge;

at least a first layer of fiber reinforced plastic and at least a second layer of fiber reinforced plastic with insulating foam disposed therebetween;

the longitudinal edges and the lateral edges of the roof assembly formed in part by bonding respective portions of the first layer of fiber reinforced plastic with the second layer of fiber reinforced plastic;

a plurality of stiffeners disposed between the first layer of fiber reinforced plastic and the second layer of fiber reinforced plastic; and the stiffeners spaced from each other and extending from the first longitudinal edge to the second longitudinal edge.

13. A roof assembly for a temperature controlled railway car having a composite box structure mounted on a railway car underframe comprising:

the roof assembly having a generally elongated, rectangular configuration corresponding approximately with configurations of the composite box structure and the railway car underframe;

the roof assembly having a generally arcuate configuration extending from a first longitudinal edge of the roof assembly to a second longitudinal edge of the roof assembly;

the roof assembly having a cross section defined in part by a first layer of fiber reinforced plastic and a second layer of fiber reinforced plastic;

the first layer and second layer cooperating with each other to encapsulate insulating material therebetween;

the first longitudinal edge and the second longitudinal edge of the roof assembly formed in part from at least the two layers of fiber reinforce plastic;

a plurality of trim moldings attached to and extending between the roof assembly and adjacent interior portions of the composite box structure;

the trim moldings having generally arcuate configurations; and an air plenum assembly attached to and extending from an interior surface of the roof assembly.

14. The roof assembly of claim 13 further comprising:

each plenum panel having a generally elongated, rectangular configuration;

the number of plenum panels used to form the air plenum assembly approximately equal to the length of the roof assembly divided by the width of the respective plenum panels; and respective connectors coupling adjacent longitudinal edges of the plenum panels with e ach other.

15. A composite box structure mounted on a railway car underframe comprising:

a floor assembly mounted on and attached to the railway car underframe;

a pair of side wall assemblies and a pair of end wall assemblies attached to the floor assembly and the railway car underframe;

each side wall assembly and each end wall assembly having an exterior surface formed from a plurality of metal sheets;

foam insulation bonded with interior surfaces of the metal sheets;

a temperature control unit mounted on one of the end wall assemblies;

a roof assembly attached to and coupled with the side wall assemblies and the end wall assemblies opposite from the floor assembly;

the roof assembly having a generally arcuate configuration;

an air plenum assembly attached to and extending from an interior surface of the roof assembly;

an interior bulkhead disposed adjacent to and spaced from the one end wall assembly to provide portions of an airflow path to return air from an interior of the composite box structure to the temperature control unit;

a first end of the air plenum assembly coupled with a portion of the interior bulkhead to provide portions of an airflow path to supply air from the temperature control unit to the interior of the composite box structure;

a plurality of plenum panels disposed adjacent to each other and respectively attached with the roof assembly;

a chute assembly forming a portion of the air supply flow path from the temperature control unit to the air plenum assembly defined in part by a first support disposed on and attached with an upper portion of the interior bulkhead;

a transition panel attached with the first support and extending at an angle between the upper portion of the interior bulkhead and the air panel assembly; and a first side panel and a second side panel respectively attached to opposite edges of the transition panel to direct airflow from the temperature control unit to the air plenum assembly.

16. The composite box structure of claim 15 wherein the floor assembly further comprises a primary floor and a secondary floor with an airflow path formed between the secondary floor and the primary floor to provide portions of an airflow path for supplying air to the interior of the composite box structure.

17. The composite box structure of claim 15 further comprising an airflow coupling extending between a second end of the air plenum assembly and at least one airflow path disposed on an interior surface of the other end wall assembly.

18. A roof assembly for a railway car comprising:

the roof assembly having a generally elongated, rectangular configuration;

an air plenum assembly attached to and extending from an interior surface of the roof assembly;

the air plenum assembly operable to receive air from a temperature control unit and to provide portions of an airflow path from the temperature control unit;

the air plenum assembly formed in part by a plurality of plenum panels disposed adjacent to each other;

a first longitudinal edge and a second longitudinal edge spaced from each other and extending from a first lateral edge to a second lateral edge;

at least a first layer of fiber reinforced plastic and at least a second layer of fiber reinforced plastic with insulating foam disposed therebetween;

the longitudinal edges and the lateral edges of the roof assembly formed in part by bonding respective portions of the first layer of fiber reinforced plastic with the second layer of fiber reinforced plastic;

a plurality of stiffeners disposed between the first layer of fiber reinforced plastic and the second layer of fiber reinforced plastic; and the stiffeners spaced from each other and extending from the first longitudinal edge to the second longitudinal edge.

19. A roof assembly for a temperature controlled railway car having a composite box structure mounted on a railway car underframe comprising:

the roof assembly having a generally elongated, rectangular configuration corresponding approximately with configurations of the composite box structure and the railway car underframe;

the roof assembly having a generally arcuate configuration extending from a first longitudinal edge of the roof assembly to a second longitudinal edge of the roof assembly;

the roof assembly having a cross section defined in part by a first layer of fiber reinforced plastic and a second layer of fiber reinforced plastic;

the first layer and second layer cooperating with each other to encapsulate insulating material therebetween;

the first longitudinal edge and the second longitudinal edge of the roof assembly formed in part from at least the two layers of fiber reinforce plastic;

a plurality of trim moldings attached to and extending between the roof assembly and adjacent interior portions of the composite box structure;

the trim moldings having generally arcuate configurations;

an air plenum assembly attached to and extending from an interior surface of the roof assembly formed in part from a plurality of plenum panels;

each plenum panel having a generally elongated, rectangular configuration;

the number of plenum panels used to form the air plenum assembly approximately equal to the length of the roof assembly divided by the width of the respective plenum panels; and respective connectors coupling adjacent longitudinal edges of the plenum panels with each other.

* * * * *